US008869807B2

(12) United States Patent
Olson

(10) Patent No.: US 8,869,807 B2
(45) Date of Patent: Oct. 28, 2014

(54) APERTURE BRUSH WITH ENGAGING PRODUCT INSERT

(75) Inventor: Stephanie Ann Olson, Brighton, MI (US)

(73) Assignee: Stephanie Ann Olson, Brighton, MI (US)

( * ) Notice: Subject to any disclaimer, the term of this patent is extended or adjusted under 35 U.S.C. 154(b) by 74 days.

(21) Appl. No.: 13/597,176

(22) Filed: Aug. 28, 2012

(65) Prior Publication Data

US 2014/0060561 A1 Mar. 6, 2014

(51) Int. Cl.

| | |
|---|---|
| ***A45D 6/02*** | (2006.01) |
| ***A45D 6/04*** | (2006.01) |
| ***A45D 24/16*** | (2006.01) |
| ***A45D 24/22*** | (2006.01) |
| ***A46B 5/00*** | (2006.01) |
| ***A46B 9/02*** | (2006.01) |
| ***A46B 15/00*** | (2006.01) |
| ***A46B 11/00*** | (2006.01) |

(52) U.S. Cl.

CPC ..... *A46B 5/0095* (2013.01); *A45D 24/16* (2013.01); *A46B 9/023* (2013.01); *A46B 15/0051* (2013.01); *A46B 11/001* (2013.01)

USPC ..... 132/237; 132/120; 132/112

(58) Field of Classification Search

CPC .. A46B 7/04; A46B 11/00; A46B 2200/1046; A46B 5/0095; A46B 11/001; A46B 15/0051; A46B 9/023; A45D 6/04; A45D 24/16; A45D 2/32; A45D 2/2464; A45D 2/2471

USPC ..... 132/237, 212, 119.1, 120, 271, 333, 132/200, 109–116, 320, 221, 210, 207, 132/226; 15/201, 207.2, 202, 184, 106, 34, 15/176.1, 176.2, 172, 144.1, 144.3, 144.4, 15/176.6; 119/600, 602, 611, 612, 614, 119/615, 664, 603, 605, 613, 625, 627, 119/633; 401/285, 280, 281, 272, 279, 265, 401/26, 29, 32, 158, 162, 163, 165, 166, 401/167, 169, 170

See application file for complete search history.

(56) References Cited

U.S. PATENT DOCUMENTS

| | | | | | |
|---|---|---|---|---|---|
| 1,159,789 | A | * | 11/1915 | North et al. | 132/112 |
| 2,336,717 | A | * | 12/1943 | Crimmins | 401/22 |
| 2,565,889 | A | * | 8/1951 | Schroer | 132/112 |
| 3,262,459 | A | * | 7/1966 | Sheehan | 132/212 |
| 3,908,679 | A | | 9/1975 | Wright | |
| 4,030,158 | A | | 6/1977 | Blair et al. | |
| 4,073,027 | A | * | 2/1978 | Tsuruzawa et al. | 15/172 |
| 4,076,032 | A | * | 2/1978 | Misercola | 132/212 |
| 4,567,905 | A | * | 2/1986 | Stewart et al. | 132/212 |
| 4,605,023 | A | * | 8/1986 | Modin | 15/145 |
| 4,619,012 | A | * | 10/1986 | Wachtel | 15/187 |
| 4,875,792 | A | * | 10/1989 | Canada | 401/283 |

(Continued)

*Primary Examiner* — Vanitha Elgart

(57) ABSTRACT

A brush for the hair and scalp which is able to disperse styling products, therapeutic, and medicated treatments from a coated insert when used with a hair dryer. The brush's handle having a lever which is able to progress and retract the aligning of cylindrical housing tubes encasing a product insert. When the user desires the product application, the lever is engaged allowing air to pass through the brush barrel and the cylindrical housing tubes moving the product to the hair or scalp. When the lever and cylindrical housing tubes are not engaged, the brush can be used as any other brush would be.

15 Claims, 9 Drawing Sheets

ASSEMBLED BRUSH VIEW

(56) References Cited

U.S. PATENT DOCUMENTS

| | | | | | |
|---|---|---|---|---|---|
| 4,938,621 | A | | 7/1990 | Pyrozyk | |
| 5,076,298 | A | * | 12/1991 | Busch et al. | 132/109 |
| 5,091,630 | A | * | 2/1992 | Djuric | 219/222 |
| 5,343,880 | A | * | 9/1994 | McKay | 132/116 |
| 5,365,880 | A | * | 11/1994 | South | 119/602 |
| 5,901,711 | A | * | 5/1999 | Jeremy | 132/226 |
| 5,927,290 | A | | 7/1999 | Thiruppathi | |
| 5,992,423 | A | * | 11/1999 | Tevolini | 132/200 |
| 6,230,716 | B1 | * | 5/2001 | Minoletti | 132/226 |
| 6,502,585 | B1 | * | 1/2003 | Mazzei et al. | 132/237 |
| 6,725,495 | B1 | * | 4/2004 | Habibi | 15/160 |
| 7,320,148 | B1 | * | 1/2008 | Willette | 15/203 |
| 7,322,364 | B2 | | 1/2008 | Hurwitz | |
| 7,814,917 | B2 | * | 10/2010 | Hurwitz | 132/116 |
| 7,832,413 | B2 | * | 11/2010 | Walters et al. | 132/108 |
| 7,845,360 | B2 | * | 12/2010 | Walters et al. | 132/108 |
| 8,132,569 | B2 | * | 3/2012 | Akerman | 132/120 |
| 8,353,076 | B1 | * | 1/2013 | Asta | 15/172 |
| 8,418,700 | B2 | * | 4/2013 | Guthans | 132/237 |
| 8,671,499 | B2 | * | 3/2014 | Lim et al. | 15/184 |
| 2006/0026783 | A1 | * | 2/2006 | McKay | 15/104.94 |
| 2008/0105274 | A1 | * | 5/2008 | Kennedy | 132/210 |
| 2008/0149124 | A1 | * | 6/2008 | McKay | 132/116 |
| 2009/0025247 | A1 | * | 1/2009 | Yde et al. | 34/60 |
| 2009/0083986 | A1 | * | 4/2009 | Langley et al. | 34/98 |
| 2009/0229624 | A1 | * | 9/2009 | Purvis et al. | 132/120 |
| 2010/0236571 | A1 | * | 9/2010 | Haziza | 132/210 |
| 2010/0269847 | A1 | * | 10/2010 | Upshaw | 132/226 |
| 2012/0017932 | A1 | * | 1/2012 | Takehana | 132/211 |
| 2013/0153461 | A1 | * | 6/2013 | Hein et al. | 206/581 |

* cited by examiner

ASSEMBLED BRUSH VIEW

HANDLE SECTION VIEW

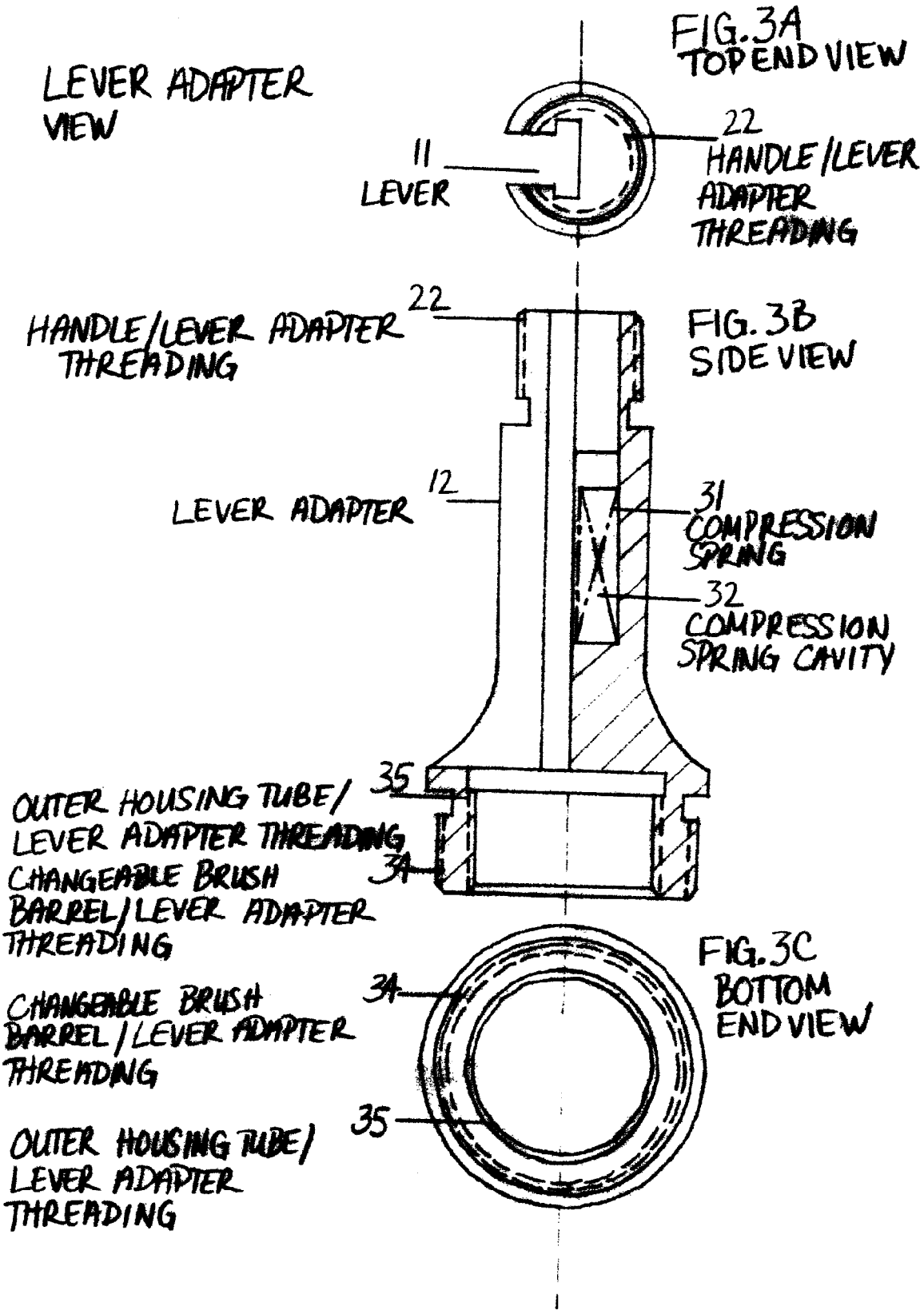
FIG. 3A
TOP END VIEW
LEVER ADAPTER VIEW
11
LEVER
22
HANDLE/LEVER ADAPTER THREADING
22
HANDLE/LEVER ADAPTER THREADING
FIG. 3B
SIDE VIEW
12
LEVER ADAPTER
31
COMPRESSION SPRING
32
COMPRESSION SPRING CAVITY
35
OUTER HOUSING TUBE/ LEVER ADAPTER THREADING
34
CHANGEABLE BRUSH BARREL/LEVER ADAPTER THREADING
FIG. 3C
BOTTOM END VIEW
34
CHANGEABLE BRUSH BARREL/LEVER ADAPTER THREADING
35
OUTER HOUSING TUBE/ LEVER ADAPTER THREADING

LEVER VIEW

SIDE VIEW

BOTTOM END
VIEW

INNER HOUSING TUBE VIEW

TOP VIEW

52 CONNECTOR SLOT

SIDE VIEW

53 AIR FLOW HOLES

51 INNER TUBE HOUSING

OUTER HOUSING TUBE VIEW

PRODUCT INSERT EXAMPLES

CHANGEABLE BRUSH BARREL EXAMPLES
FIG.8A
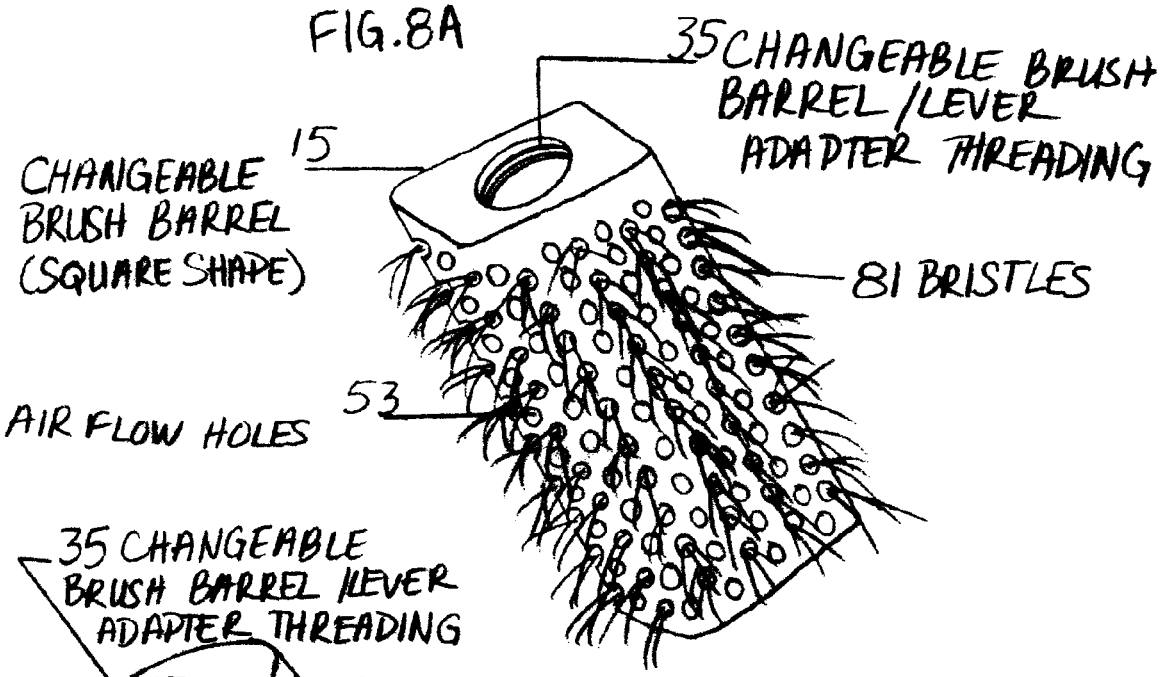
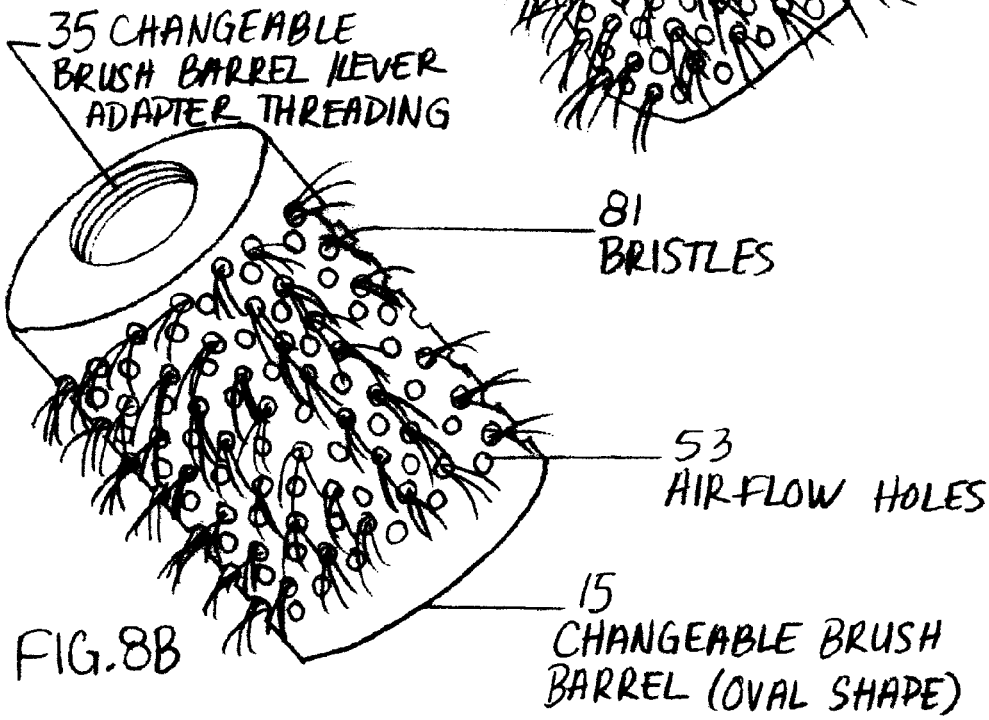
FIG.8B

APERTURE BRUSH WITH ENGAGING PRODUCT INSERT

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field

This application relates to a brush, specifically a cylindrical aperture tube and lever assembly located in the interior of a handled brush embodiment that allows the option of a desired product to be dispersed when used with a blow dryer.

2. Prior Art

Previously while styling and drying a person's hair at home or in a professional salon setting it is common to apply products of differing mediums (ex: gel, mousse, creams, or sprays) to enhance or change the texture of hair. While this is a very basic technique it is undesirable to people for many reasons. Some people may have difficulty applying the product properly to a specified area or using the wrong amount while some may have a problem with residue or overspray left on their surroundings or body. In an effort to remedy this situation these prior art brush constructions show an interest of combining the brush and product application into one step.

The means provided in transferring the grooming products to the hair and/or scalp in these prior art references are at the earlier stages of being efficient and effective. U.S. Pat. No. 5,927,290 (1999) to Thiruppathi incorporates a container filled with a liquid styling agent that is dispersed through a spray nozzle when driven by a trigger. While having the convenience of a product and brush integrated it leaves the problem of overspray and limits the product use to liquid forms. U.S. Pat. No. 4,938,621 (1990) to Prozyk is a brush which includes a mechanism for dispensing mousse. Again, combining the product with the brush yet limiting the product used to only be mousse. U.S. Pat. No. 3,908,679 (1975) to Wright discloses a brush for grooming hair which provides a layer of a conditioning material adjacent to the base of the bristles to interact with hair during brushing. It would be difficult to control the amount used and the method of distribution while again limiting the type of product which can be used. U.S. Pat. No. 4,875,792 (1989) to Canada discloses a vented brush where the product insert is encased in wax which must be heated to a certain temperature to be applied to the hair when used with a hair dryer. The temperature of hair dryers definitely differs between models and it would be a challenging task to know the moment the insert was at the melting point and start blowing a heated solution on the head and scalp. U.S. Pat. No. 7,322,364 (2008) to Hurwitz discloses a brush wherein the product is forced through hollowed bristles when a button is pushed. This method is troublesome in noting the amount of product used and the forced direction it would move. Other brush designs such as those described by U.S. Pat. No. 4,030,158 (1977) to Blair and U.S. Pat. No. 4,076,032 (1978) to Misercola are designed to facilitate their use with a hot air hair dryer for styling, but they do not dispense any grooming treatment material to the hair or scalp.

SUMMARY

In accordance with one embodiment of a brush with an aperture tube assembly contained inside the brush barrel, activated by a lever allowing air to flow through the aperture tube assembly, dispersing a product from a coated insert.

DRAWINGS

Figures

FIGS. 3A, 3B, & 3C shows top, side, and bottom views of the lever adapter.

Figure 4A:
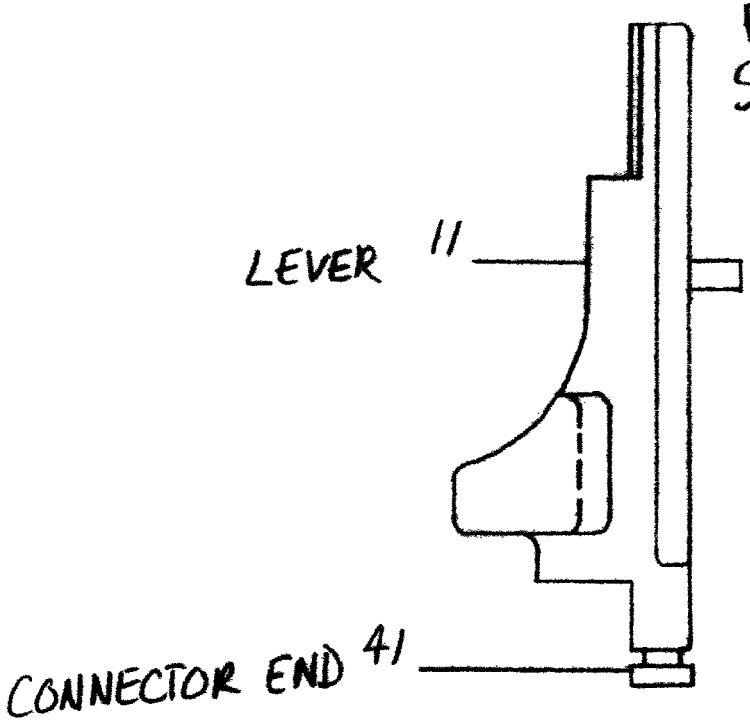
Figure 4B:
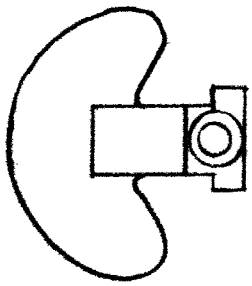

FIGS. 4A & 4B is a side and bottom view of the lever.

Figure 5A:
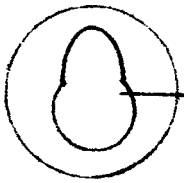
Figure 5B:
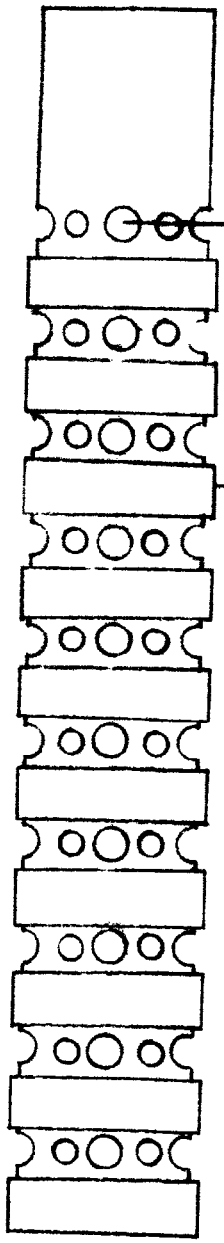

FIGS. 5A & 5B is the top and side view of the inner housing tube.

Figure 6:
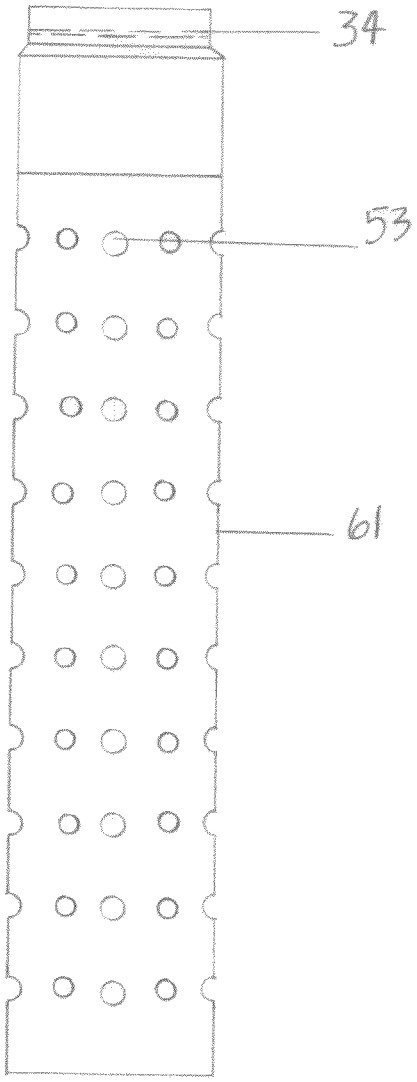

FIG. 6 is a side view of the outer housing tube.

Figure 7A:
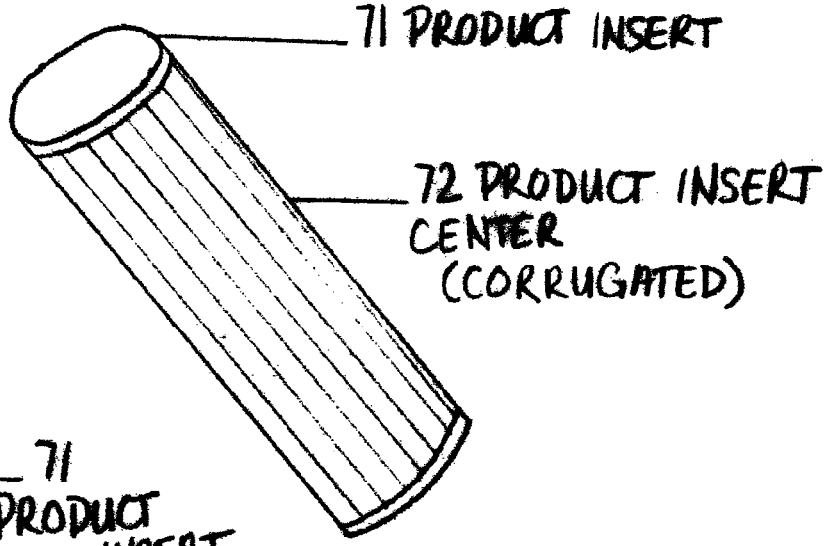
Figure 7B:
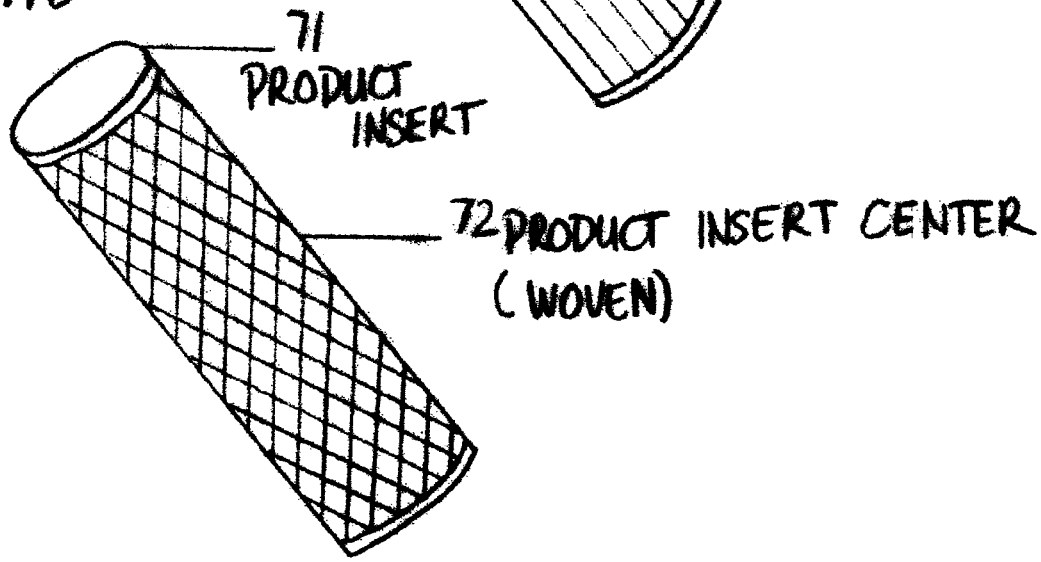

FIGS. 7A & 7B are examples of product inserts.

FIGS. 8A & 8B are examples of changeable brush barrels.

Figure 1:
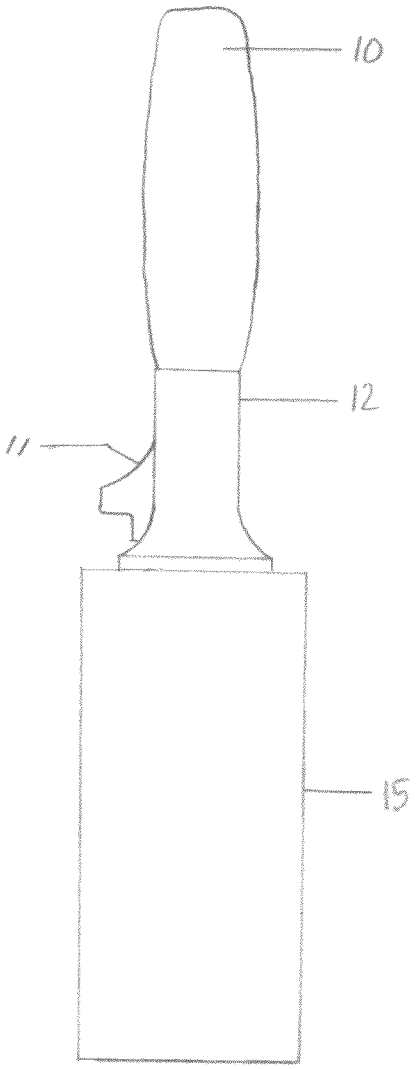
FIG. 1 is a full side view of the brush embodiment.
Figure 9:
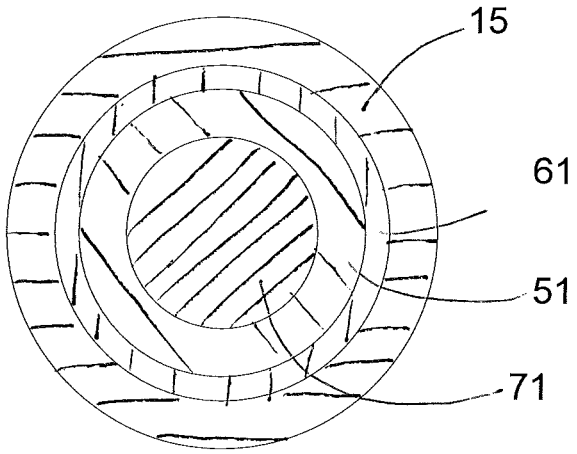

FIG. 9 is an example of a cross sectional view taken generally along the brush of FIG. 1.

DRAWINGS-Reference Numerals

| | | | |
|---|---|---|---|
| 10 | handle | 11 | lever |
| 12 | lever adapter | 15 | changeable brush barrel |
| 21 | handle/lever adapter | 22 | handle/lever adapter threading |
| 31 | compression spring | 32 | compression spring cavity |
| 34 | changeable brush barrel/lever adapter threading | | |
| 35 | outer housing tube/lever adapter threading | | |
| 41 | connector end | 51 | inner housing tube |
| 52 | connector slot | 53 | air flow holes |
| 61 | outer housing tube | 71 | product insert |
| 72 | product insert center | 81 | bristles |

DETAILED DESCRIPTION

FIGS. 1, 2, 3A, 3B, 3C, 4A, 4B, 5A, 5B, 6, 7A, 7B, 8A, & 8B

FIG. 1 illustrates a perspective view of one version of this brush. It has an elongated handle 10 with a sloped lever 11 and is attached to a larger cylindrical shaped changeable brush barrel 15.

Figure 2:
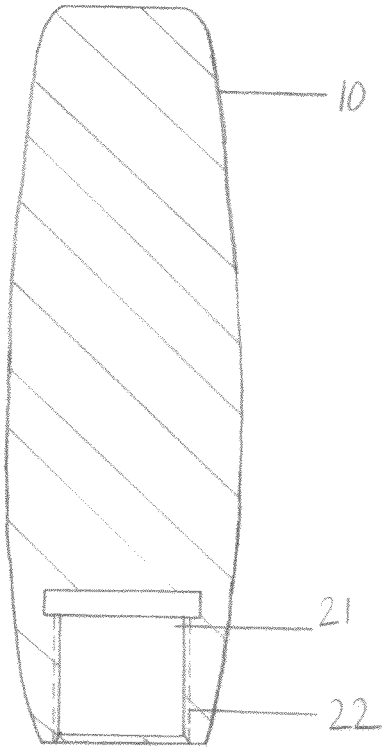
FIG. 2 is a section view of the handle.

FIG. 2 shows a section view of the handle 10 which is an elongated oblong cylindrical shape. Both ends are blunt with the bottom end showing a handle/lever adapter 21 and the handle/lever adapter threading 22. This is the opening where the lever adapter 12 fits and is fastened to the handle by way of the handle/lever adapter threading 22.

The handle 10 could be produced from a metal, plastic, or any material that would keep a rigid shape. Plastic would likely be preferred in this embodiment due to its durability and light weight. The handle 10 could even be coated with another material that would increase comfort or be easier to grip while using. The shape, sizing, and length of the handle 10 could be adjusted to enhance the grip and comfort of the brush.

FIGS. 3A, 3B, & 3C illustrate the lever adapter 12. The top view (3A) shows how the lever 11(shown in FIG. 4) fits into the lever adapter 12. This view also shows the handle/lever adapter threading 22 which is how the handle 10 and lever adapter 12 are fastened together.

The side view (3B) of the lever adapter 12 shows it is an oblong shape with blunt ends. The top side is narrower than the bottom. The top end fits into the handle 10. The side view (3B) also shows a rectangular compression spring cavity 32 which houses the compression spring 31.

The lever adapter 12 is the first item needed to assemble the brush. The compression spring 31 is set into the compression spring cavity 31 located in the lever adapter 12. The lever 11 slides onto the lever adapter 12 and is then screwed into the handle 10 by way of the handle/lever adapter threading 22. The lever adapter 12 provides the means to progress and retract the lever 11 shown in FIG. 4.

FIG. 3C shows the bottom view of the lever adapter 12 which features the outer housing tube/lever adapter threading 35 and the changeable brush barrel/lever adapter threading 34. These threading's allow the outer housing tube 61 and the changeable brush barrel 15 to be fastened to the brush embodiment.

The lever adapter 12 could be made of metal, plastic, or any material that was light weight and would keep a rigid shape. The compression spring 31 should be composed of a metal that would be durable and have memory to aid in keeping the coiled shape.

FIGS. 4A & 4B show the side and bottom view of the lever 11. The front view (4A) of the lever 11 show it being a rectangular shape which is narrow at the top and has a slope flaring out from one side. The opposite side of the lever 11 has a protruding knob approximately at the center.

FIG. 4B shows the bottom view featuring the connector end 41. The connector end 41 fits into the connector slot 52 shown in FIG. 5A.

The lever 11 should also be made of metal, plastic, or any material that was light weight and would keep a rigid shape. Again, the lever 11 could be coated with another material that would lessen the chance of slippage when the lever 11 is engaged. The shape, sizing, and length of the lever 11 could be adjusted to enhance the grip and comfort of the brush. FIGS. 5A and 5B is the inner housing tube top and front view. The top view (5A) features an oblong connector slot which fastens the inner housing tube 51 to the connector end 41 of the lever 11 shown in FIG. 4.

FIG. 5B shows the inner housing tube 51 is cylindrical in shape with several air flow holes 53. This figure also shows solid horizontal bands of a larger circumference than the bands featuring the airflow holes 53.

The inner housing tube 51 could be made from metal, plastic, or any material that was light weight, would keep a rigid shape, and tolerate heat from a hair dryer.

FIG. 6 illustrates the outer housing tube 61. It is a cylindrical tube in shape and the circumference is slightly larger (allowing for clearance) than the inner housing tube 51. The outer housing tube 61 shows the outer tube housing/lever adapter threading 34 and a plurality of air flow holes 53.

The outer housing tube 61 should be made from metal, plastic, or any material that was light weight, would keep a rigid shape, and tolerate heat from a hair dryer. The outer housing tube/lever adapter threading 34 fastens to the threading of the same name shown in the lever adapter 12 in FIG. 3.

FIGS. 7A & 7B depict two examples of product inserts 71 and product insert centers 72 which are a cylindrical tube shape and fit inside the inner housing tube 51. 7A is a corrugated pattern and 7B is a woven pattern.

The product insert center 72 could be made from a textured fabric or paper that could tolerate heat from a hair dryer and also be coated and retain hair styling aids or treatment for the hair or scalp. The product insert 71 could possibly contain plastic or metal components that would help with reinforcement or aid in retaining the styling or treatment products. The texture, pattern, or design configurations for the product insert center 72 would rely upon what was found to retain and disperse each product in the most fitting manner.

FIGS. 8A & 8B display two examples of the changeable brush barrels 15. The example given in FIG. 8A is a tubular square shape and FIG. 8B is a tubular oval shape. The only size or shape limitation of the changeable brush barrel 15 is to be larger than the outer housing tube 61. The two figures also show a plurality of air flow holes 53 along with a plurality of bristles 81 which extend radially from the barrel.

The changeable brush barrel 15 could be made of metal, plastic, or any material that was light weight, would keep a rigid shape, and tolerate heat from a hair dryer. The bristles 81 could be made from plastic, nylon, a natural animal hair or any material that allowed movement, and could tolerate the heat of a hair dryer, while being gentle to the hair and scalp.

The changeable brush barrel/lever adapter threading 35 is also shown and is fastened to the threading of the same name shown in the lever adapter 12 in FIG. 3.

Operation—First Embodiment—FIGS. 1, 2, 3B, 4A, 5B, 6, 7, 8A, & 8B The manner of using this brush is very similar to how you would operate any other brush to aid in the shaping when used along with a hair dryer to detangle or style dry or wet hair. The common method involves sectioning the hair into smaller segments that are easier to work with. Generally a person would start brushing near the root area and pull the brush away from the scalp simultaneously in the same direction along with the hair dryer for the length of the hair. When the desired outcome was achieved a person would move to the next section and repeat the process working toward completing the entire head of hair.

Possible wanted results of using a brush or brush and hair dryer together would be straightening, smoothing, or adding volume or wave. What sets this brush apart and is novel, is the point in and manner in which a hair product or treatment is applied to the hair and or scalp.

Often a hair product is distributed to damp hair by using your hands which can be messy leaving greasy, tacky, or an irritating residue behind. Then a brush and hair dryer would be used together to dry the sections into a desired shape. Now, the chosen product is coated on an interchangeable product insert 71 (Much like a 'dryer sheet' as it is used to the process of laundry. The sheet is merely a means of carrying the fabric softener which was once a liquid form.). Most styling aids, therapeutic scalp treatments, and medicated hair or scalp applications could be replicated to this new form producing a multitude of product insert 71 choices. Not only would treatments and medications be more convenient to use and apply, but the warm air from the hair dryer would open the pores of the scalp forcing the products to be absorbed for an improved result.

The product insert 71 sits inside the inner housing tube 51. When the product application is wanted, the lever 11 on the handle 10 is manually moved forward and the air flow holes 53 of the inner 51 and the outer housing tube 61 align to allow air to pass through moving the hair product to the hair. The lever 11 is returned to its beginning position by the compression spring 31 when the lever 11 is released. While the lever 11 was at the beginning position, the larger bands on the inner housing tube 51 will align with the air flow holes 53 of the outer housing tube 61 not allowing air to pass through the center. The outer housing tube 61 remains stationery, while the lever 11 moves the inner housing tube 51. The occasion of the lever 11 being engaged would depend upon the intended outcome of the style.

For example, if volume was wanted, a section of hair at the root would be grasped by the bristles 81 with the oval shaped changeable brush barrel 15. The hair dryer would be directed opposite the hair was to the brush. The lever 11 on the handle 10 would be moved briefly, allowing the volumizing product to travel through the inner 51 and outer housing tube 61 onto the hair only in the specified area.

This technique would result in the roots being aided by the product but not weighing down the length of the hair, which would be adverse to the desired result.

Another example can be given if straightening or smoothing the hair was desired. The hair section would be grasped by the bristles 81 with the square shaped changeable brush barrel 15 at the root area and be brushed in a simultaneous motion in the same direction of the hair dryer (with the hair dryer pointed on the opposite side of the hair) for the length of the hair section. In this example the lever 11 would be moved and kept in the engaged position during the entire passage that the product application was desired. The lever 11 would then be disengaged and the following passages of the section would be with the brush under the tautly pulled section and the hair dryer would be aimed to blow air from the same side as the hair was grasped by the bristles 81.

A wavy or 'round brushed' look can also be achieved using the oval shaped changeable brush barrel 15. When the user has the brush at the end of a dry length of hair it would then be loosely rolled under on the brush toward the scalp, making sure the brush was rotated in a straight fashion not crossing any strands and keeping the section free from tangling. When the brush reached the scalp, the hair dryer would be aimed at the brush and the lever 11 moved briefly. The air from the dryer would penetrate the hair and dispense a blast of product to the hair from the inside giving the section a weightless soft hold. After holding the brush in place for a moment, it can loosely be pulled from the hair revealing another beautiful styling option.

Saving time restyling or protecting hair color from fading as a consequence of washing, are two reasons that a person would not want to wash their hair every day. In this instance a dry shampoo or style extending product insert 71 would be used to freshen up the hair. The same dry shampoo or style extending product insert 71 could also remove unwanted smells and be refreshing after perspiration has occurred. The hair would be sectioned as described above and restyled according to the desired result.

On the occasion the desired product was a therapeutic or medicated scalp treatment, the hair would be sectioned and gripped near the root by the bristles 81. The hair dryer would then be aimed at the root and scalp area of the section until warm. The lever 11 would then be moved to the engaged position allowing the product to be moved to the root and scalp area. This method would be advantageous over applying topically because the warmth of the hair dryer would open the pores on the scalp helping to direct the product to be absorbed into the desired area. This process would be repeated until the entire intended area was completed.

To change the product insert 71, the changeable brush barrel 15 would be unscrewed from the lever adapter 12 and removed to expose the inner housing tube 51. The product insert 71 would easily slide out and could be replaced. This is the same procedure to switch the changeable brush barrel 15 shapes.

The combinations of products and brush techniques are only limited by the user's imagination and creative knowledge of how the product is designed to work.

Description and Operation of Alternative Embodiments

It is well known in the hair styling profession that there are several kinds of brushes available to best fit an array of hair styling needs. I can foresee implementing the same levered apparatus in many other brush designs to achieve all the advantages given by the brush embodiment described.

Paddle brushes could be fit with the levered assembly and disperse products just as the barreled brush embodiment. A variation of that same paddle brush would be to use either a synthetic looped or natural animal bristle to appeal to clients that wear hair extensions.

A vented brush is another popular type of brush that could be fitted with a levered assembly and disperse products with the aid of a hair dryer.

The arrangement of bristles, length of bristles, how and where they were placed on the changeable brush barrel, as well as the mapping of air flow holes would be another way to explore alternative embodiments of this brush. A variety of sizes and diverse shaped changeable brush barrels is yet another aspect this brush embodiment could be customized.

Another ramification to explore would be the design structure of the product insert. There are many different textured construction forms that would function well with this embodiment.

The order in which the brush is assembled could also certainly be altered to administer similar results.

Advantages

The advantages detailed in the operation portion are not the only benefits to this brush embodiment. For instance, it allows the user to bring along styling products in the form of product inserts without having to carry bulky, fragile or leaky containers which is amazingly convenient for travel. This would also enable the user to use a diverse collection of changeable brush barrels, yet only needing one handled brush. Products could now be applied to the hair and scalp with little to no skin contact diminishing the concern of over-exposure for allergy sufferers. Another benefit achieved with this new system of applying products is the ability to use multiple products on the same head without overlapping and weighing down a person's hair. Furthermore, safety is achieved in keeping your hands clean and dry especially when adding the use of hot tools.

Having a brush that disperses products as I have described above makes this brush embodiment completely unique. Adding the feature of being able to also choose from a collection of different sized and shaped brush barrels has not been previously executed.

Conclusion, Ramifications, and Scope

Consequently the reader will see a variety of advantages the described brush embodiment has to offer in the way of convenience, product and treatment applications, styling options, as well as added benefits of caring for the hair and scalp. This embodiment is appealing to professional stylists and clients for use at home or on the go.

You can also see the embodiment is not limited by sizes or shapes and is not confined by materials it could be manufactured from. Aside from containing the components that have been drawn and described in great detail, the possibilities of using the characteristics of the brush embodiment could absolutely be transferred to other brush embodiments to achieve similar grooming goals.

What is claimed is:

1. A hair brush, comprising:

an elongated handle to be gripped by a hand, said handle including a lever assembly, a brush barrel operably connected to said handle, said brush barrel having a surface;

inner and outer housing tubes, said outer housing tube having an inner volume in which the inner housing tube is positioned, said inner housing tube including an inner volume, each one of said inner and outer housing tubes having a plurality of air flow holes formed through a surface thereof, a coated insert removably positioned in the inner volume of the inner housing tube and impregnated with a desired hair styling product, hair or scalp treatment, medicated hair or scalp treatment, said brush barrel having a plurality of bristles extending radially from around the surface of said brush barrel, and said brush barrel having a plurality of air flow holes formed through the surface thereof, wherein the lever assembly is to move the inner housing tube and the outer housing tube, relatively, so that material from the coated insert can be dispersed through the air flow holes of the inner housing tube and the outer housing tube and through the brush barrel.

2. The hair brush as recited in claim 1, said air flow holes of the cylindrical housing tubes are offset when assembled and in a beginning position to close any movement from the coated insert through said air flow holes of the cylindrical housing tubes.

3. The hair brush as recited in claim 1, said air flow holes of the inner and outer housing tubes align when said lever is engaged to allow movement from the coating insert through said air flow holes of the inner and outer housing tubes.

4. The hair brush as recited in claim 1, wherein each of said inner and outer tubes are cylindrical and are graduated with different diameter bands.

5. The hair brush of claim 1, wherein an adapter connects to said handle and said brush barrel.

6. The hair brush as recited in claim 1, wherein said handle includes a recess to receive the lever assembly, the lever assembly including a lever that is adjacent the brush barrel and is biased in a first position to close the air holes of the outer housing tube, and the lever is moveable to a second position against the bias to open the air holes of the outer housing to the air holes of the inner housing.

7. The hair brush as recited in claim 1, wherein said inner housing tube is completely positioned in said outer housing tube.

8. A hair brush to be held by a hand, having bristles, and to selectively deliver product to hair, comprising:

an elongate handle; and a brush assembly connected to the handle and to selectively deliver product to the hair, the brush assembly including:

an outer housing having an inner volume, a plurality of outer housing apertures through an outer surface of the outer housing, an inner housing positioned in the inner volume of the outer housing and movable between a first position and a second position, the inner housing having an inner volume and a plurality of inner housing apertures, in the first position the inner housing apertures are not in fluid communication with the outer housing apertures, in the second position the inner housing apertures are in fluid communication with the outer housing apertures, and a product carrier with product and removably positioned in the inner housing, the product on the product carrier being in fluid communication from the product carrier with the inner housing apertures, in the first position product is not available outside the brush assembly and in the second position product is available outside the outer housing.

9. The hair brush of claim 8, wherein the handle includes means to move the inner housing between the first position and the second position.

10. The hair brush of claim 8, wherein the handle includes a lever that can be engaged by a hand of a user that is holding the handle, and the lever is connected to the inner housing to move the inner housing from the first position to the second position.

11. The hair brush of claim 10, wherein the lever is biased to the first position.

12. The hair brush of claim 10, wherein the handle includes a spring that biases the lever to the first position.

13. The hair brush of claim 10, wherein the product carrier is woven to support the product.

14. The hair brush of claim 10, wherein the product carrier carries at least one of hair styling product, hair treatment, scalp treatment, medicated hair treatment, or medicated scalp treatment.

15. The hair brush of claim 10, wherein the lever is biased to the first position, wherein a spring biases the lever to the first position, wherein the product carrier is woven to support the product, wherein the outer housing is cylindrical, and wherein the inner housing is cylindrical.

* * * * *